United States Patent [19]

Fangmeier et al.

[11] 4,056,958

[45] Nov. 8, 1977

[54] METHOD AND APPARATUS FOR STRAIGHTENING OF ELONGATED WORKPIECES

[75] Inventors: Ralf Fangmeier, Solingen; Lothar Bracht, Wuppertal, both of Germany

[73] Assignee: Th. Kieserling & Albrecht, Solingen, Germany

[21] Appl. No.: 718,659

[22] Filed: Aug. 25, 1976

[30] Foreign Application Priority Data

Aug. 27, 1975 Germany ..... 2532622

[51] Int. Cl.[2] ..... B21D 3/04

[52] U.S. Cl. ..... 72/98; 72/99

[58] Field of Search ..... 72/95, 98, 99, 100, 72/110, 111, 160

[56] References Cited

U.S. PATENT DOCUMENTS 3,747,386 7/1973 Hartkopf ..... 72/99

FOREIGN PATENT DOCUMENTS 2,103,892 8/1972 Germany ..... 72/160

*Primary Examiner*—Lowell A. Larson

*Attorney, Agent, or Firm*—Michael J. Striker

[57] ABSTRACT

A method of straightening elongated workpieces of circular or other cross section comprises subjecting a portion of the workpiece during its movement in longitudinal direction thereof to rotary bending forces so that successive curvatures of the workpiece in a zone trailing said portion in said direction gradually increase to thereby surpass the yield point of the material of the workpiece and in a zone leading said portion in said direction gradually decrease in such a manner that the decrease of the curvatures and the corresponding decrease of the plasticity of the workpiece occurs slower than the increase thereof, and an apparatus for carrying out the method.

22 Claims, 13 Drawing Figures

FIG. 1
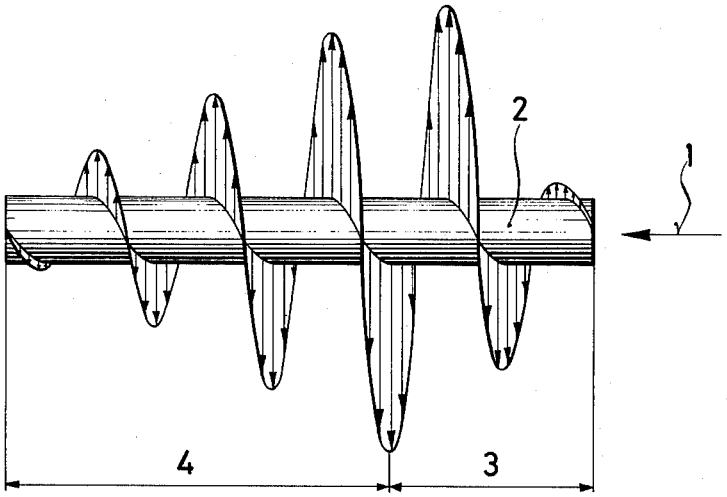
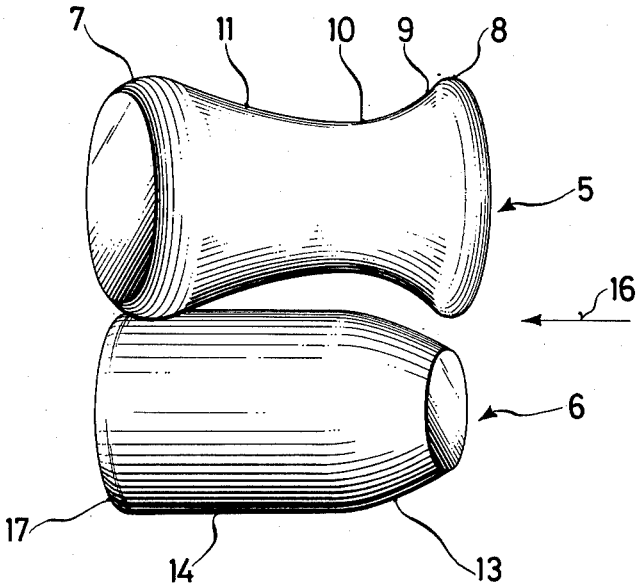
FIG. 2

FIG. 3
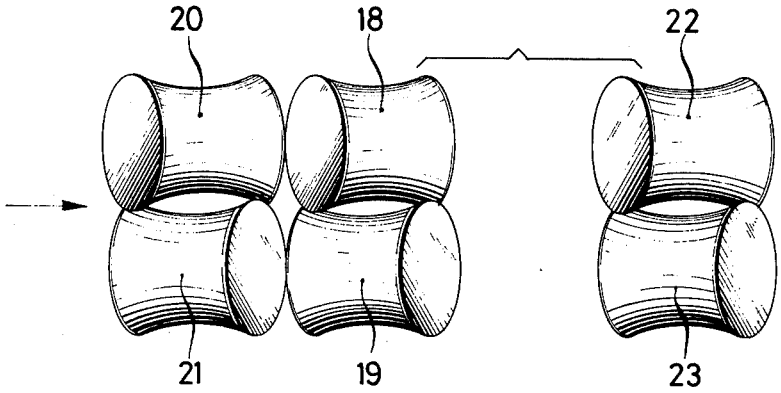
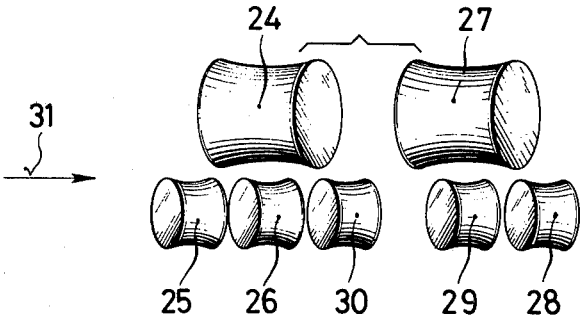
FIG. 4
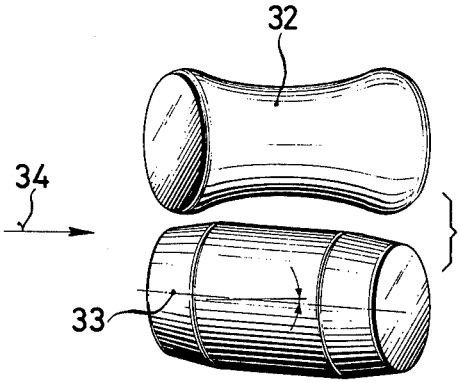
FIG. 5

METHOD AND APPARATUS FOR STRAIGHTENING OF ELONGATED WORKPIECES

BACKGROUND OF THE INVENTION

The present invention relates to a method of straightening elongated workpieces of profiled cross section in which the workpiece attains successive curvatures which first increase to thereby surpass the yield point of the material of the workpiece and which subsequently decrease, as well as to an apparatus for carrying out the method.

During straightening of elongated workpieces it occurs quite often that the desired tolerance of straightness is not obtained. This occurs especially in cases in which the workpiece is formed of special material with a high elastic limit and/or a small modulus of elasticity so that the straightening thereof is connected with considerable difficulties.

In certain cases there is also a high degree of straightening required, for instance for the subsequent grinding of straightened rods of blank steel in which the required straightness can also not be obtained with methods and apparatus known in the art.

It is known to straighten elongated workpieces of profiled cross section by subjecting it to revolving bending forces. In straightening elongated workpieces of full circular cross section this is usually carried out in straightening apparatus having two rolls or in straightening apparatus having an orbiting straightening tool and in straightening of tubes of cylindrical cross section such straightening is usually carried out in straightening appartus having six or seven rolls. Other straightening apparatus are also known in the art, for instance a straightening apparatus as disclosed in the German Patent 1,071,447 in which elongated workpieces of a cross section different from a circular cross section can be straightened and in which the workpiece is passed successively through a plurality of nozzles mounted on oscillating arms. This known apparatus is however rather complicated and has not found great acclaim in the art.

SUMMARY OF THE INVENTION

It is an object of the present invention to improve the process of straightening a workpiece by means of revolving bending forces by changing the course of the thereby produced curvatures.

This object is obtained according to the present invention with a method and apparatus in which the attenuation of the curvatures in the plastically deformed region of the workpiece occurs slower than the increase thereof. In the course of increase and decrease of the curvatures which, according to the present invention are imparted to a cross section of the workpiece during its passage through the bending zone, it is possible to carry out in the region of the decreasing curvatures more plastic bending and counterbending as in methods according to the prior art, whereby the straightening obtained is improved. In the region of the decreasing curvatures, especially in the section of the workpiece in which it is still at least partly in plastic condition, the result of the straightening process is essentially influenced. The flat character of the enveloping curve drawn tangential to the peaks of successive curvatures in the region of the decreasing curvatures will result further that the smallest remaining rest curvature, which is the cause of the slightly corkscrew shape of the straightened workpiece, is considerably reduced. The reaction force imparted by the workpiece on guides of the straightening apparatus is, according to the invention, also reduced at differently outlet end of the apparatus, whereby the surface quality of the straightened workpiece is increased and formation of grooves in the workpiece is prevented or at least reduced to a considerable extent.

In an advantageous arrangement of the present invention it is possible to assure that, in the region of the decreasing curvature, only those curvatures will attenuate slowly in which the material of the workpiece is still in the plastic state, whereas the following strictly elastic curvatures will decrease quickly. This will result that a greater number of curvatures can be obtained in the region in which the material of the workpiece is still in plastic condition, whereby the straightness obtained is further improved. The corresponding enveloping curve will be still flatter so that the remaining rest curvatures may be further reduced. The number of strictly elastic bends, which have no influence on the straightness obtained, will be essentially reduced.

The method according to the present invention may be carried out in a straightening apparatus having two superimposed straightening rolls rotatable about axes including an angle with each other, in which one of the rolls is a concave roll and in which the location of the smallest diameter of the concave roll is located outside the longitudinal center of the roll and shifted toward the inlet side of the apparatus. This concave roll is therefore assymetrical. The overall length of the roll is not influenced thereby. The other roll is so constructed that in the region of the maximum bending moments an equidistant straightening gap will be formed between the two rolls. The other roll is thereby provided at the inlet side preferably with a convex section, depending on the curvature of the hyperbolic first roll, which convex section passes into a cylindrical section opposite the smallest diameter of the concave roll. The characteristic feature of the assymetrically constructed concave straightening roll in a two-roll-straightening apparatus has the additional advantage with respect to straightening apparatus known in the art that, with the same radial and angular arrangement of the two rolls, an increased curvature of the workpiece can be obtained. In this way, the two roll straightening apparatus according to the present invention can be used for straightening workpieces of different nature, especially of workpieces having small diameters, high yield point, respectively a small modulus of elasticity and which are extensively curved before the straightening thereof.

By shifting the smallest diameter of the concave roll to the inlet side of the apparatus, the overall length of the roll will not be influenced. This will facilitate adaption of existing two-roll-straightening apparatus in accordance with the present invention. The flatter arrangement of the contour of the concave roll at the outlet side thereof will lead also to a smaller exit angle of the workpiece as compared to a workpiece axis of straight run, so that the usually provided channel receiving the workpiece after its passage through the gap between the two rolls has only to be slightly inclined, which facilitates the adjustment of the apparatus.

In a two-roll-straightening apparatus according to the present invention it has proven especially advantageous to construct the concave straightening roll in such a manner that the relationship of the length sections to opposite sides of the smallest diameter is between 1 to 1.4 and 1 to 2.5.

In accordance with a further feature of the present invention, the superimposed rolls of a two-roll-straightening apparatus are arranged in such a manner that the crossing point of the two rolls, as viewed from above, is moved from the longitudinal center of the rolls toward the inlet side of the apparatus. This makes it possible to maintain an equidistant straightening gap in the region of the smallest diameter of the concave roll, independent of the tilting of the two rolls.

Two-roll-straightening apparatus are usually also employed for polishing the workpiece. This polishing task is carried out in the region of the greater curvature of the workpiece between the two straightening rolls. This polishing task requires an equidistant straightening gap between the two rolls. The crossing point of the center line of the workpiece with the roll axes coincides with the abovementioned crossing point.

In accordance with a further feature of the present invention, the axis of one of the two rolls is tilted from a horizontal position slightly toward the incoming workpiece. This feature which can be auxiliarily used will also provide good straightening results.

The profile of the concave roll is preferably formed by two sections of differently shaped hyperpoloids. This provides the possibility of manufacturing the concave roll with only slightly increased cost with machine tools used for this purpose.

The lower of the two superimposed rolls may have a cylindrical portion having one end opposite the smallest diameter portion of the upper concave roll and two crown portions projecting to opposite sides of the cylindrical portion eccentrically arranged with respect thereto and increasing in diameter in the direction away from said opposite ends. Such a roll arrangement may also be used in two-roll-straightening machines in which no straight edge guides are used for guiding the workpiece on opposite sides thereof during its passage between the rolls.

The method according to the present invention can also be used in straightening apparatus having at least three rolls, two of which have axes located in a common plane, and wherein the third of the rolls if spaced a smaller distance from the one of the two rolls which is located upstream of said third roll, as considered in the direction of movement of the workpiece, than from the other of the two rolls. The apparatus according to the present invention may also comprise three pairs of superimposed rolls spaced from each other in the direction of movement of the workpiece, in which all of the rolls are concave rolls and in which the distance of the smallest diameters of the center pair of the two pairs of rolls from the pair of rolls upstream therefrom, as considered in the direction of movement of the workpiece, is smaller than from the pair of rolls downstream therefrom. By transferring the idea of the roll formation and arrangement in a two-roll-straightening machine to a straightening apparatus having three pairs of rolls, it is likewise possible to obtain the effect according to the present invention. In such a modification the rolls of the center pair of rolls have a distorted profile, that is the smallest diameter thereof is shifted towards the inlet side of the apparatus. These two characteristics may also be combined with each other.

According to a further feature of the present invention it is advantageous to provide in straightening apparatus with three or more rolls an adjusting device for the last straightening roll or the last pair of straightening rolls, as considered in the direction of the movement of the workpiece, by means of which the deflection of the bent workpiece may be varied. In this way the deflection of the workpiece may be adjusted at a straightening tool which is at least loaded. Due to this arrangement the adjusting device may be constructed relatively light.

According to a further feature of the present invention the last straightening roll, respectively the last pair of straightening rolls, may also be adjusted in the direction of movement of the workpiece.

The advantages of the straightening process according to the present invention are especially pronounced if used in a straightening apparatus having an orbiting tool. The present invention includes thereof also a straightening apparatus in which a straightening tool movable along a circular path is arranged between tool means engaging the workpiece passing therethrough at opposite sides thereof and which are spaced at a fixed distance from each other in the direction of movement of the workpiece and in which the orbiting tool, which engages the workpiece to bend the latter, is spaced from the tool means upstream thereof, as considered in the direction of movement of the workpiece, a distance smaller than from the other of the tool means. This arrangement differs essentially from straightening apparatus of the aforementioned kind in which the orbiting tool is arranged midway between the other pair of tools and which will result in three regions with substantially equally large plastic deformation of the workpiece. The shifting and distortion of these plastic regions, according to the present invention, will result in that the bending moment at the tool means at the delivery side of the apparatus will decrease in relationship to the bending moment at the orbiting tool, which leads to an improvement of the straightening results. It is especially advantageous to move the orbiting bending tool so far out of the center toward the inlet side of the apparatus so that in the region of the orbiting bending tool a great plastic deformation of the workpiece will occur, whereas the tool at the outlet end will be subjected only to elastic loads. In this arrangement the omission of the third region of plastic deformation is especially advantageous. The middle region of the curvatures which are coordinated with the orbiting straightening tool, is changed in such a manner that the maximum value of the curvatures of the workpiece is shifted towards the inlet side whereas the bends, especially bends within the plastic region of the workpiece decrease slowly.

In accordance with a further feature of the present invention, the roll cooperating with the concave roll in a two-roll-straightening machine, may be formed of two parts and one of the parts may be moved toward the concave roll by double eccentric means mounting the one roll part. In this way the bending of the workpiece will occur over a large region of the bending zone in which the material of the workpiece will be plastically deformed. At the same time the number of the elastic bends which are unimportant for the straightening result are reduced.

In its starting position the double eccentric mounted roll part is coaxially arranged with the adjacent roll part.

The adjustable roll part is preferably mounted at an axial pinion of the other roll part.

According to another embodiment of a two-roll-straightening apparatus for carrying out the method according to the present invention, the roll cooperating with the concave roll may be provided at its upstream end face, as considered in the direction of movement of the workpiece, with a large central bore into which a pinion of the roll frame extends, on which a swing bearing is provided for pendulating mounting of the roll, and in which this roll has adjacent the aforementioned end face a spherical zone having a center substantially coinciding with the center point of the swing bearing. In this arrangement known means are coordinated with the central trunion projecting from the other end face of the roll for tilting the same about the swing bearing to thereby change the gap between the two rolls.

In a further advantageous embodiment of the present invention, the roll cooperating with the concave roll has two end portions in the form of spherical zones in which the maximum diameter of the downstream end portion, as considered in direction of movement of the workpiece, is smaller than that of the other end portion, in which the two end portions are connected to each other by a portion of a length which is about a third of the total length of this roll, and in which the connecting portion has a contour which is curved along a curvature smaller than the corresponding bend line of the workpiece. In this way, the zone in which the plastic bends are decreasing is elongated. This will improve the straightening result and at the same time reduce the corkscrew shape of the workpiece.

The same advantageous results are obtainable in a three-roll-straightening apparatus in which the roll cooperating with the two other rolls is a two part roll and in which the downstream part of this two part roll may be adjusted in radial direction toward the workpiece by means of a double eccentric arrangement.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 schematically illustrates the course of the bends imparted to a workpiece during the straightening thereof in accordance with the method of the present invention;

FIG. 2 is a schematic perspective view of two rolls in a two-roll-straightening apparatus according to the present invention;

FIG. 3 is a schematic perspective view of the arrangement of the rolls for carrying out the method according to the present invention in a six-roll-straightening apparatus;

FIG. 4 is a perspective view showing the arrangement of the rolls in a seven-roll-straightening apparatus;

FIG. 5 is a perspective view showing a special arrangement of the rolls for carrying out the method according to the present invention in a two-roll-straightening apparatus;

DESCRIPTION OF THE PREFERRED EMBODIMENTS

Figure 6:
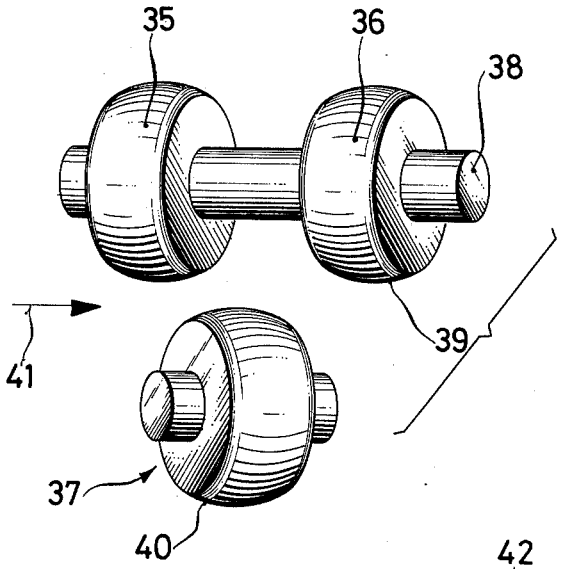
FIG. 6 is a perspective view showing the arrangement of the rolls for carrying out the method of the present invention in a three-roll-straightening apparatus.

In some of the Figures the trunions projecting from opposite ends of the rolls by means of which the rolls are turnably mounted in the roll stand, not illustrated in the drawing, are for simplification reasons omitted, but it is to be understood that each of the rolls is provided with trunions projecting from opposite end faces for mounting the rolls in a roll stand. The workpiece, which is passed through the gap between the illustrated rolls in order to be straightened, is moved in longitudinal direction either by additional drive rolls, not shown in the drawing, and engaging the workpiece, or at least one of the rolls which carry out the actual straightening operation is driven for moving the workpiece in longitudinal direction.

FIG. 1 schematically illustrates the course of the bends or curvatures imparted to a cross-section of a workpiece 2 during passage through a bending zone of a straightening apparatus according to the present invention. Thereby the workpiece 2 moves relative to the tools in direction of the arrow 1. The course of the orbiting curvatures shows, in the inlet zone 3, a very pronounced increase, to surpass the yield point of the material of the workpiece. A region 4 follows the region 3 in which the orbiting curvatures decrease. The succession of curvatures in the region 4 has a substantially smaller size than that in the region 3. The length relationship of the regions 3 and 4 is substantially 0.4 to 0.7. Due to the division of the bending zones in the regions 3 and 4, the number of decreasing bends is considerably increased. The flatter course of the decreasing bends will assure that the last plastic deformation remaining in the workpiece will be reduced and the corkscrew form of the final product will be improved.

FIG. 2 illustrates a concave upper roll 5 and the coordinated lower roll 6 in a two-roll-straightening apparatus according to the present invention. The concave upper roll has a form which can be compared with an over dimensioned "diabolo." The two crowns 7 and 8 of the concave upper roll have substantially identical maximum diameters. Following the crown 8, at the upstream end of the upper roll 5, as considered in the direction of movement of the workpiece which is indicated by the arrow 16, is a section 9, which decreases rapidly in diameter to the smallest diameter at the region 10, and the location of the smallest diameter is shifted from the longitudinal center of the roll toward the crown 8. The region 10 of the smallest diameter is followed by an extended concave region 11 in which the diameter of the roll gradually increases.

The sections 9 and 11 are preferably formed as two differently curved hyperpoloids. The lower roll 6 has a substantially bullet-shaped form, with a section 13 in form of a spherical zone, which is joined by a cylindrical section 14 ending in a convexly curved end portion 17 with a small radius of curvature.

Figure 7:
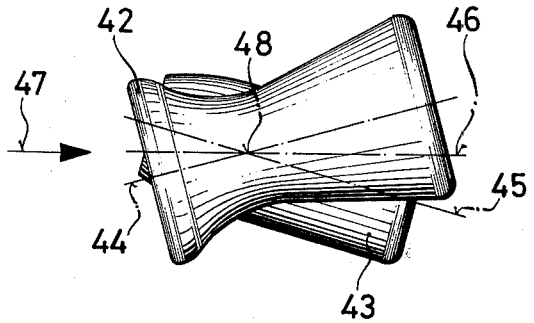
FIG. 7 is a top view of a roll arrangement similar to that shown in FIG. 2.

The lower roll 6 is constructed and arranged in such a manner that between the same and the upper roll 5 an equidistant straightening gap in the region of the smallest diameter of the upper roll with result. The rolls 5 and 6 are, as comparatively shown in FIG. 7 in top view, arranged inclined with respect to each other, that is, the axes of the rolls cross each other as shown in FIG. 7. The region at which the spherical section 13 passes into the cylindrical section 14 of the lower roll 6 is arranged opposite the smallest diameter portion 10 of the upper roll 5. The nonillustrated workpiece passes in the direction of the arrow 16 between the rolls 5 and 6.

FIG. 3 illustrates the roll arrangement in a six-roll-straightening apparatus having three pairs of superimposed substantially concave rolls, in which the middle roll pair 18, 19 is shifted toward the upstream roll pair 20, 21, that is the roll pair at which the workpiece enters into the apparatus, the arrow to the left of the roll pair 20, 21 indicating the firection of movement of the workpiece through the apparatus. As clearly shown in FIG. 3, the distance between the roll pair 18, 19 and the roll pair 20, 21 is considerably smaller than that between the roll pair 18, 19 and the roll pair 20, 23 at the outlet end of the apparatus. The distance between the roll pair 20, 21 and the roll pair 22, 23 corresponds to the usual distance in a six-roll-straightening apparatus. The relationship of the distance between the roll pairs 18, 19 and 20, 21 to the distance between the roll pair 18, 19 and the roll pair 22, 23 is substantially between 1 to 1.4 and 1 to 2.5.

FIG. 4 illustrates a seven-roll-straightening apparatus according to the present invention, in which the rolls 24, 25, 26, on the one hand, and the rolls 27, 28, 29, on the other hand, have substantially the task to radially engage the non-illustrated workpiece from opposite sides. The plastic deformation of the workpiece is essentially carried out by the roll 30. This roll 30 is shifted in a direction opposite to the direction of movement of the workpiece, as indicated by the arrow 31, out of the center of the roll arrangement, in other words, the roll 30 is closer to the upper roll 24 than to the upper roll 27.

FIG. 5 shows a possibility to improve the straightening result in a two-roll straightening apparatus with rolls of known configuration by means of a special arrangement of the rolls. The straightening rolls 32 and 33 are of conventional configuration as used in a two-roll-straightening apparatus. The upper roll 32, which is concave, has its smallest diameter at the longitudinal center of the roll. The lower roll 33 is likewise of symmetrical configuration. By special arrangement of these rolls, the straightening result may be improved in substantially the same manner as is the arrangement of the rolls illustrated in FIG. 2. For this purpose, the axis of the lower roll 33 is tilted slightly out of the horizontal position toward the incoming workpiece. By this tilting of the lower roll, the gap between the two rolls is at the downstream end of the two rolls slightly enlarged. Furthermore, the roll arrangement will result in a shifting of the bending force towards the upstream end of the two rolls, which will improve the straightening result. The movement of the workpiece through the gap between the two rolls is indicated by arrow 34.

The baic principle of the present invention may also be used in a three-roll straightening apparatus as illustrated in FIG. 6. In this arrangement there are three rolls 35, 36 and 37 provided. The rolls 35 and 36 are mounted on common shaft 38. The roll 36 is axially shiftable on the shaft 38, by known means not illustrated in the drawing. All of the rolls have a convex outer surface. The roll 35 has at its end, adjacent the lower roll 37, a profile which decreases abruptly. Coordinated with the decreasing profile, the lower roll 37 has a portion 40 of sharply increasing diameter. The lower roll 37 has its largest diameter shifted out of the center of the roll toward the upper roll 37 and this largest diameter portion of the lower roll is followed by a section of small curvature extending towards the downstream end of the lower roll. The peripheral surface 39 of the upper roll 37 has the smallest curvature of the three rolls. The axis of the lower roll includes an angle with the common axis of the upper roll. The lower roll 37 is shifted, out of the center between the two upper rolls 35 and 36, toward the upper roll 35, that is the upstream of the two upper rolls, as considered in the direction of the movement of the workpiece which is indicated by the arrow 41.

FIG. 7 illustrates a top view of a pair of rolls 42 and 43 of a two-roll-straightening apparatus. As viewed in the top view of FIG. 7, the two axes 44 and 45 of the two rolls cross each other at the point 48 and the not-illustrated workpiece is passed in between the two rolls in the direction of the arrow 47, so that the workpiece axis passes also through the crossing point 48. The upper roll 42 has a configuration as described above in connection with FIG. 2 and the smallest diameter of the upper roll 42 is arranged substantially in the region of the crossing point 48. The relationship of the distance of the crossing point 48 from the left end, that is the inlet end of the two rolls to the distance of the crossing point from the right end of the rolls is substantially between 1 to 1.4 and 1 to 2.5.

Figure 8:
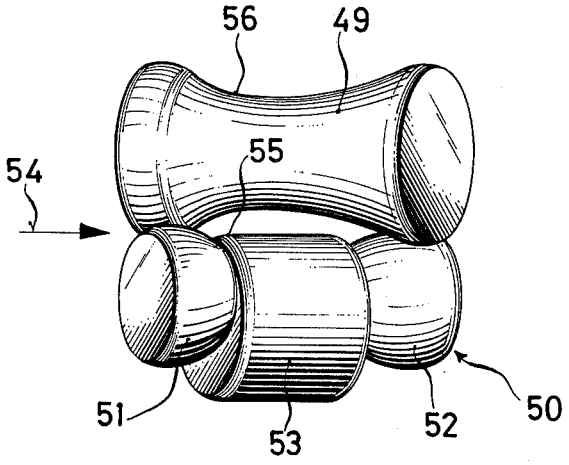
FIG. 8 is a perspective view of a roll arrangement according to the present invention in a straightening apparatus without straight guides to opposite sides of the workpiece.

FIG. 8 illustrates the roll arrangement for a two-roll-straightening apparatus which can be operated without any usually provided guide members for guiding the workpiece on opposite sides during its passage between the rolls. The roll arrangement as shown in FIG. 8 comprises an upper roll of a configuration corresponding to that described above in connection with FIG. 2 whereas the lower roll 50 is a three part roll. The axes of the rolls 49 and 50 include again an angle with each other. The outer two roll parts 51 and 52 of the lower roll 50 are eccentrically mounted on the middle roll part 53 and adjustable on eccentrics, not shown in FIG. 8. The outer parts cooperate with the upper roll 49 in a manner similar to a second concave roll. The non-illustrated workpiece is fed between the two rolls in the direction as indicated by the arrow 54. The outer roll parts 51 and 52 are adjusted in such a manner that between the same and the corresponding portions of the upper roll 49 gaps will result which are smaller than the diameter of the workpiece to be straightened. The helically advancing workpiece passes through these two gaps and is laterally guided by the portions of the two rolls forming the gaps. The upstream part 51 of the three part lower roll is shorter than the downstream part 52. The upstream part 51 has a pronounced convex aperture. The central part 53 has, similar as the lower roll 37 of FIG. 6, at its upstream end 55 a sharply rounded portion with an abruptly increasing diameter which passes, opposite the smallest diameter of the upper roll 39, into a cylindrical section.

The downstream roll part 52, that is the right roll part of the lower part 50, as viewed in FIG. 8, is likewise convexly curved, but its radius of curvature is larger than that of the upstream roll part 52. At its right end as viewed in FIG. 8, the roll part 52 is chamfered.

Figure 9:
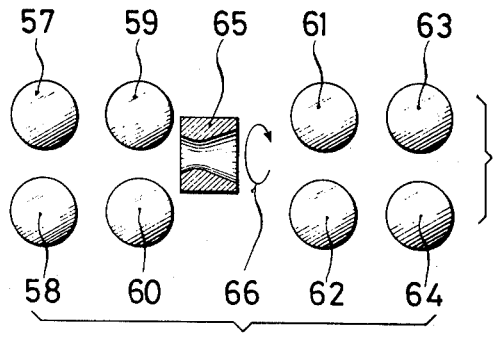
FIG. 9 is a schematic illustration of a straightening apparatus with an orbiting straightening tool.

FIG. 9 schematically illustrates a straightening apparatus which differs from the straightening apparatus so far described, but which is constructed and arranged to obtain the same results as are obtainable with the above-described straightening apparatus. The apparatus, schematically shown in FIG. 9, comprises two pairs of inlet rolls 57, 58 and 59 and 60, two pairs of outlet rolls 61, 62 and 63, 64 which respectively engage the non-illustrated workpiece, which is advanced in the direction of the arrow shown at the left side of FIG. 9, on opposite sides. A straightening tool 65 is arranged intermediate the inlet roll pair 59, 60 and the outlet roll pair 61, 62 and this straightening tool 65 is orbited along a circular path as indicated by the arrows 66 by known means of conventional construction, not illustrated in the drawing. The tool 65 is formed with a central bore therethrough, through which the workpiece passes during the operation of the apparatus, and this bore has preferably a tapering inlet section of a cone angle which is larger than that of the tapering outlet section and which is shorter than the outlet section. As clearly shown in FIG. 9 the tool 65 is shifted toward the inlet roll pair 59, 60, so that the distance of the tool 65 from this roll pair is shorter than the distance of the tool 65 from the outlet roll pair 61, 62. This will assure that the same results can be obtained with the apparatus schematically shown in FIG. 9 as with the prior described apparatus.

Figure 10:
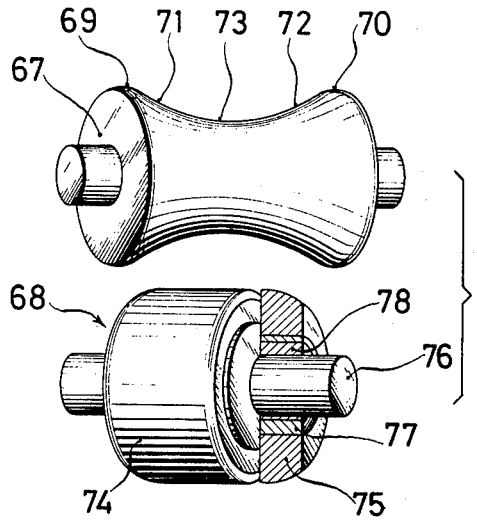
FIG. 10 is a perspective view of the roll arrangement in a two-roll-straightening apparatus in which the lower roll is formed of two parts.

FIG. 10 illustrates a further roll arrangement for a two-roll-straightening apparatus. This arrangement includes again an upper roll 67 and a lower roll 68. The concave upper roll 67 has, starting from the crowns 69, 70, two sections 71 and 72 with sharply reducing diameters which are joined by an elongated flatter section 73. A convexly curved lower roll 68 is coordinated with the concave upper roll 62. The lower roll 68 is a two part roll having a longer main part and a shorter part 75. The shorter part 75 is turnably mounted, by means of a double eccentric arrangement 77, 78, on a central trunion 76 projecting from the right end, as viewed in FIG. 10, from the main part 74. The part 75 is arranged at the downstream end, as considered in the direction of the movement of the workpiece indicated by the arrow at the left side of FIG. 10. By shifting the double eccentric arrangement 77, 78 about the axis of the trunion 76 in circumferential direction, by conventional means not shown in the drawing, the roll part 75 may be moved toward and away from the opposite portion of the concave roll 67. The axial length of the roll part 75 is about a quarter of the axial length of the main part 74.

Figure 11:
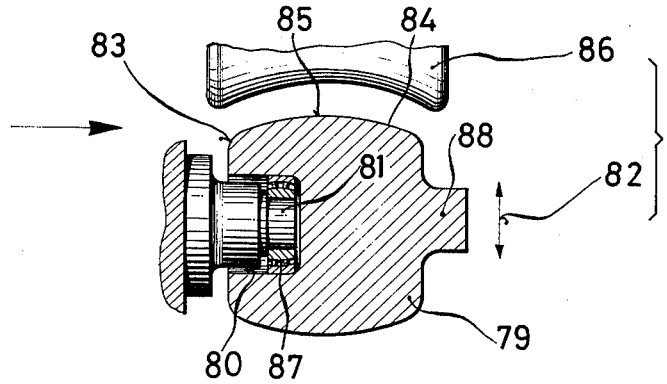
FIG. 11 is a partial, partially sectioned side view and especially illustrating the lower roll in a two-roll-straightening apparatus.

FIG. 11 illustrates a further roll arrangement for a two-roll-straightening apparatus according to the present invention. The non-illustrated workpiece is advanced between the upper concave rolls 68 and the convexly curved lower roll 79 in the direction of the arrow, as shown at the left side of FIG. 11. The lower roll 79 of this arrangement is a one-piece roll, provided with a large diameter blind bore 80 extending from its upstream end face, as considered in the direction of the movement of the workpiece, into the lower roll. A bearing trunion 81, fixedly mounted on the non-illustrated frame of the straightening apparatus, extends with clearance into the bore 80 and the bearing trunion 81 carries at its end of reduced diameter a swing bearing 87 so as to mount the lower roll 79 rotatable about its axis and tiltable in the drawing plane. The mounting of the lower roll and the contour of its peripheral face are harmonized in such a manner that a tilting movement of the lower roll 79 in the direction of the double-headed arrow 82 by means known in the art and acting on the trunion 88 extending from the right end of the lower roll 79, as viewed in FIG. 11, will not cause an essential change in the gap between the upper and the lower roll at the upstream end, or left end as viewed in FIG. 11, between the two rolls. Assuming the mounting end of the lower roll 79 is shifted by the aforementioned arrangement towards the upper roll, then an additional bending force is imparted to the workpiece by such shifting. The contour of the lower roll is considerably convexly curved at opposite ends, whereas the curvature of the region therebetween is flatter. The center of curvature of the section 83 coincides substantially with the center of the swing bearing 87. The upper roll 86 cooperating with the lower roll 39 has substantially the same contour as described above in connection with the upper roll 67 of FIG. 10. It is to be understood that the axes of the two rolls shown in FIG. 11 include again an angle with each other, which is not illustrated in FIG. 11 in order to show the tilting arrangement for the lower roll more clearly.

Figure 12:
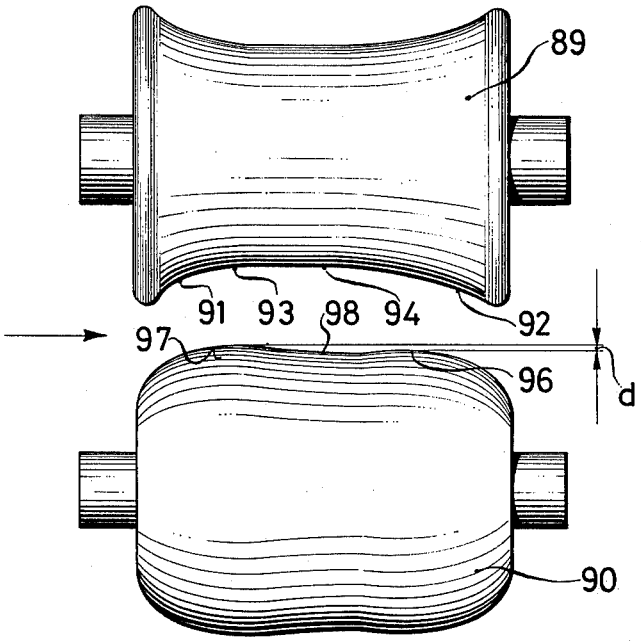
FIG. 12 is a schematic side view of a two-roll-straightening apparatus in which the lower roll has a special configuration.

FIG. 12 illustrates a further roll arrangement according to the present invention. It is to be understood that in this arrangement the axes of the two roll include again an angle with each other, which is not shown in FIG. 12 to more clearly illustrate the contour of the lower roll 90. The upper roll 89 of the arrangement shown in FIG. 12 has pronouncedly curved end sections 91 and 92. The relationship of the length of the sections of the upper roll 89 to opposite sides of the section of smallest diameter 93 is preferably between 1 to 1.4 and 1 to 2.5. The section 91 is followed, in the direction of movement of the workpiece between the rolls, by a section 94, the radius of curvature of which increases very gradually. Toward the downstream end of the upper roll the curvature of the roll contour increases again more steeply in the roll section 92. The part spherical downstream end section 96 of the convex lower roll 90 is arranged opposite this pronouncedly curved section 92 of the upper roll. The part spherical roll section 97 at the upstream end of the lower roll of the lower roll 90 is arranged upstream of the section 93 of smallest diameter of the concave upper roll 89. The section 98 of the lower roll 90 between the end sections 96 and 97 has a curvature which is smaller than the corresponding bending line of the workpiece. The maximum diameter of the upstream end section 97 is larger by the dimension $d$ than the maximum diameter of the downstream end section 96.

Figure 13:
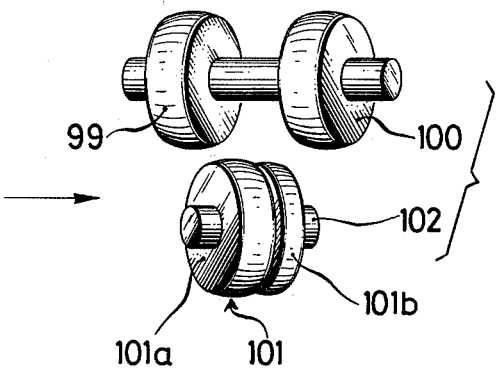
FIG. 13 is a perspective view of the roll arrangement in a three-roll-straightening apparatus with a special construction of the lower roll.

The roll arrangement shown in FIG. 13 has two upper rolls 99 and 100 of a contour corresponding to that of the rolls 35 and 36 shown in FIG. 6. The lower roll 101 arranged between the two upper rolls, and as in FIG. 6 closer to the roll 99, is a two part roll constructed in the same manner as the roll 68 shown in FIG. 10. The downstream part **101*b* of the lower roll is again adjustably mounted on a double eccentric arrangement, not shown in FIG. 13 and, correspondingly to the double eccentric arrangement of FIG. 10, on the central trunion 102 of the upstream roll part 101*a*, so that the downstream part 101***b* can be adjusted in radial direction toward the non-illustrated workpiece which is adapted to move between the rolls in the direction of the arrow shown at the left side of FIG. 13.

It will be understood that each of the elements described above, or two or more together, may also find a useful application in other types of straightening apparatus differing from the types described above.

While the invention has been illustrated and described as embodied in an apparatus for straightening elongated workpieces of profiled cross section, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of straightening elongated workpieces of circular or other cross section and having a longitudinal axis, comprising the steps of moving a workpiece in the direction of said axis; and subjecting a portion of the workpiece during its movement in said direction to bending forces rotating about said axis such that successive curvatures produced in an upstream zone of said portion as considered in said direction, increase to thereby surpass the yield point of the material of the workpiece and in a downstream zone of said portion, as considered in said direction, gradually decrease in such a manner that the decrease of the curvatures and the corresponding decrease of the plasticity of the workpiece occurs slower than the increase thereof.

2. A method as defined in claim 1, wherein in the downstream zone only the curvatures in the parts of the workpiece which are still in the plastic state decrease slowly whereas the subsequent curvatures causing only elastic deformation in the workpiece decrease abruptly.

3. Apparatus for straightening elongated workpieces comprising upstream and downstream means respectively engaging an elongated workpiece movable in axial direction on at least one side at respectively spaced apart upstream and downstream portions and third means cooperating with said upstream and downstream means and engaging a third portion on at least the opposite side intermediate said upstream and downstream portions for imparting to the workpiece bending forces rotating about the axis thereof, said third means being spaced from said upstream means by a distance smaller than from said downstream means for bending the workpiece between said upstream and downstream means beyond the yield point of the material of the workpiece and in such a manner that the increase of successive curvatures imparted to the workpiece and the corresponding change of plasticity occurs between said upstream means and said third means at a faster rate than between said third means and said downstream means.

4. An apparatus as defined in claim 3, wherein the relationship of the distance between said upstream means and said third means to the distance between said third means and said downstream means is between 1 to 1.4 and 1 to 2.5.

5. Apparatus as defined in claim 3, comprising two superimposed straightening rolls rotatable about axes including an angle with each other, one of said rolls being a concave roll having at opposite ends upstream and downstream crown portions respectively constituting said upstream and downstream means and having intermediate said crown portion a portion of smallest diameter which is spaced from said upstream crown portion by a distance smaller than from said downstream crown portions, said portion of smallest diameter constituting together with an opposite surface portion of the other roll said third means.

6. Apparatus as defined in claim 5, wherein the relationship of the distance between said upstream crown portion and the smallest diameter portion and that between the smallest diameter portion and said downstream crown portion is between 1 to 1.4 and 1 to 2.5.

7. Apparatus as defined in claim 5, wherein the superimposed rolls are arranged in such a manner that the crossing point of the axes of the two rolls, as viewed from above, is moved from the longitudinal center of the rolls toward said upstream crown portion.

8. Apparatus as defined in claim 5, wherein the profile of the concave roll is formed by two sections of differentialy shaped hyperpoloids.

9. Apparatus as defined in claim 5, wherein said other of said rolls is a three part roll having a cylindrical portion having a convexly curved end portion opposite the smallest diameter portion of said one roll and two crown portions projecting to opposite sides of the cylindrical portion and eccentrically adjustable with respect thereto and increasing in diameter in the direction away from said opposite ends.

10. Apparatus defined in claim 3, wherein said apparatus comprises at least three rolls, two of which have axes located in a common plane and arranged to engage a workpiece on one side thereof, and the third of which is arranged to engage a workpiece on the other side and is spaced a smaller distance from one of said two rolls located upstream of the third roll, as considered in the direction of movement of the workpiece, than from the other of said two rolls.

11. Apparatus as defined in claim 3, wherein said apparatus comprises three pairs of superimposed concave rolls spaced from each other in the direction of movement of the workpiece, the distance of the smallest diameters of the center pair of the three pair of rolls from the pair of rolls upstream therefrom as considered in the direction of movement of the workpiece being smaller than from the pair of rolls downstream therefrom.

12. Apparatus as defined in claim 10, wherein the position of the other of the pair of rolls is adjustable in order to change the deflection of the bent workpiece.

13. Apparatus as defined in claim 12, wherein the position of the other of the pair of rolls is adjustable in the direction of the movement of the workpiece.

14. Apparatus as defined in claim 3, wherein said upstream and downstream means are each constituted by at least two tool means spaced from each other in direction of movement of the workpiece and arranged to engage the workpiece passing therebetween, said third means comprising a tool located between said two tool means orbiting along a circular path and arranged to engage the workpiece to bend the latter, said tool being spaced from the tool means upstream thereof as considered in the direction of movement of the workpiece by a distance smaller than from the other of said tool means.

15. Apparatus as defined in claim 14, wherein each of said two tool means comprises at least one pair of vertically spaced cylindrical rolls having axes normal to the direction of movement of the workpiece and adapted to engage a workpiece on opposite sides thereof, and wherein said orbiting tool comprises a short member formed with a central bore flaring toward its opposite ends and through which the workpiece extends during operation.

16. Apparatus as defined in claim 5, wherein the other of said two superimposed rolls is formed of two parts, one located at the downstream end of said other roll as considered in the direction of movement of the workpiece, said apparatus including eccentric means mounting said one roll part for adjusting its position toward the concave roll.

17. Apparatus as defined in claim 16, wherein the other of said two parts of said other roll has a central trunion on which said eccentric means is mounted.

18. Apparatus as defined in claim 5, wherein the other of said pair of superimposed rolls has two end portions in the form of spherical zones with a maximum diameter of the downstream end portion, as considered in the direction of movement of the workpiece, smaller than that of the other end portion, said two end portions being connected to each other by a portion of a length which is about a third of the total length of said other roll and having a contour that is curved along a curvature smaller than the corresponding bending line of the workpiece.

19. Apparatus as defined in claim 10, wherein the third of the three rolls is formed of two parts, one located downstream of the other part, as considered in the direction of movement of the workpiece, and including eccentric means mounting said one part to adjust the position thereof in radial direction towards a workpiece passing through the gap between said rolls.

20. Apparatus for straightening elongated workpieces comprises a pair of superimposed rolls rotatable about axes including, as seen from above, an acute angle with each other, one of said rolls being a concave roll and the other a convex roll, said rolls defining a gap therebetween and being arranged so that a workpiece passing in longitudinal direction through said gap is rotated about its axis and bent successively in opposite directions to surpass at the point of maximum curvature the yield point of the material and in such a manner that successive curvatures imparted to the workpiece downstream of said point and the corresponding plasticity of the workpiece decrease slower than the increase thereof upstream of said point.

21. Apparatus as defined in claim 20, wherein the axis of rotation of one of said rolls is located in the horizontal plane and the axis of the other of said rolls is slightly inclined out of the horizontal toward the inlet side of the apparatus.

22. Apparatus as defined in claim 20, wherein an end face of the upstream end of said other roll is formed with a central bore, and including a stationary trunion extending into said bore and a swing bearing on said trunion for pendulating mounting the upstream end of said other roll, said other roll having adjacent said one end face a spherical zone having a center of curvature substantially coinciding with the center of said swing bearing, said other roll having a central trunion projecting from the other end face thereof, and further including means coordinated with said other trunion for tilting said other roll about said swing bearing toward and away from said one roll.

* * * * *